US005676014A

United States Patent [19]

Sanford

[11] Patent Number: 5,676,014

[45] Date of Patent: Oct. 14, 1997

[54] TRANSFER MECHANISM FOR MULTI-STAGE TRANSFER PRESS WITH CROSS BAR SUPPORTS

[75] Inventor: Kurt Sanford, Belvidere, Ill.

[73] Assignee: Chrysler Corporation, Auburn Hills, Mich.

[21] Appl. No.: 642,818

[22] Filed: May 3, 1996

[51] Int. Cl.[6] ..... B21D 43/05

[52] U.S. Cl. ..... 72/405.11; 72/405.1

[58] Field of Search ..... 72/405.11, 405.12, 72/405.09, 405.1, 405.01, 422

[56] References Cited

U.S. PATENT DOCUMENTS

| | | | |
|---|---|---|---|
| 4,807,456 | 2/1989 | Shiraishi | 72/405.1 |
| 4,866,974 | 9/1989 | Shiraishi | 72/405.1 |
| 4,970,888 | 11/1990 | Shiraishi | 72/405.1 |
| 5,248,288 | 9/1993 | Kamiya | 72/405.1 |
| 5,443,436 | 8/1995 | Kawakami | 72/405.1 |
| 5,582,061 | 12/1996 | Harsch | 72/405.1 |

*Primary Examiner*—Daniel C. Crane
*Attorney, Agent, or Firm*—Edward A. Craig

[57] ABSTRACT

A bolster supports the lower dies of a row of die sets for use in a transfer press. The upper dies are carried by a vertically reciprocable ram. Transfer mechanism is provided to move blanks along the row of die sets, comprising longitudinally extending side rails and cross bars having blank grippers releasably attached to the side rails. A plurality of stands are mounted on the bolster. The stands are adapted to support the cross bars after the cross bars have been detached from the side rails and the bolster is moved out of the press to change dies. The stands also support the cross bars in positions for re-attachment to the side rails when the bolster is moved back inside the press. Some of the stands are mounted on the bolster for pivotal movement away from the dies so that after the cross bars have been removed, there is sufficient clearance for removing and replacing the die sets. Other stands are removable.

2 Claims, 4 Drawing Sheets

TRANSFER MECHANISM FOR MULTI-STAGE TRANSFER PRESS WITH CROSS BAR SUPPORTS

FIELD OF THE INVENTION

This invention relates generally to presses and more particularly to a transfer mechanism for a multi-stage transfer press having retractable cross bar supports.

BACKGROUND AND SUMMARY OF THE INVENTION

Transfer presses employ forming dies arranged in sequence to produce a finished stamping for each stroke of the press. The dies are arranged in sets with an upper die mounted on a vertically movable ram and a lower die mounted on a bolster. To change dies for the production of other parts, the upper dies are released from the ram and placed on the lower dies, and the bolster is moved out of the press.

A transfer mechanism moves workpiece blanks from one die to the next between press strokes. The transfer mechanism comprises side rails extending along opposite sides of the row of dies, with cross bars, provided with workpiece grippers, extending between the side rails. When it is desired to move the bolster out of the press to change dies, the cross bars are detached from the side rails and placed on supports carried by the bolster.

An overhead crane is employed to remove the dies and replace them with other dies. One of the problems incident to changing dies is the very limited clearance between the dies and the cross bar supports. The cross bars are removed during the die changeover, but it is still very difficult to control a 30,000–40,000 pound die set suspended from a cable crane without some swaying and twisting. From time to time, the die sets when suspended from the cable crane, crash into the cross bar supports, damaging or bending them out of proper position. As a result, when the cross bars are again placed on the supports and the bolster is moved back into the press where the cross bars are re-attached to the side rails, the ends of the cross bars do not properly line up with the connectors on the side rails. The connectors are sometimes broken, the side rails are knocked out of reference, and the cross bars are bent. In addition the cross bar supports must be repaired after every wreck. An excessive amount of downtime results.

In accordance with the present invention, the cross bar supports are in the form of upright stands. Each cross bar stand preferably has a cross bar receiver at the upper end to receive and locate the end portion of a cross bar. At least some of the stands are pivoted at the bottom so that they may be swung away from the dies. Other stands are removable.

One object of the invention is to provide a transfer mechanism for a transfer press including retractable cross bar supporting stands having the foregoing features and capabilities.

Other objects are to provide a transfer mechanism with retractable cross bar stands which is composed of a relatively few simple parts, is rugged and durable in use, is highly effective in preventing crashes when changing dies, and is capable of being easily operated and inexpensively manufactured.

Other objects, features and advantages of the invention will become more apparent as the following description proceeds, especially when considered with the accompanying drawings.

DETAILED DESCRIPTION OF THE PREFERRED EMBODIMENT

Figure 3:
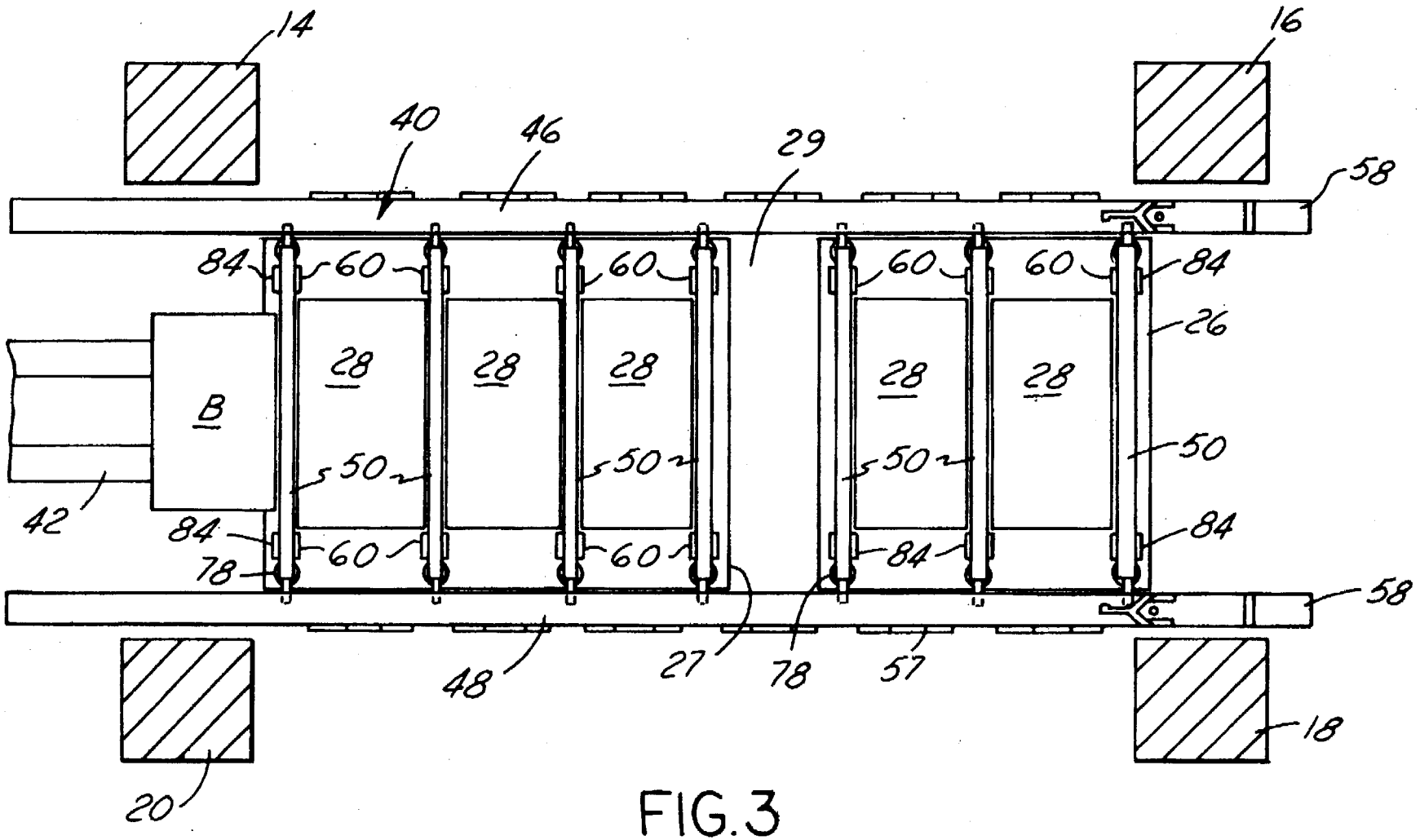
FIG. 3 is a view taken on the line 3—3 in FIG. 2, showing an entry bolster and an exit bolster inside the press.

Referring now more particularly to the drawings, the press 10 has a frame 12 provided with four vertical columns 14, 16, 18 and 20 which support the press head 22. Beneath the press head 22 on the factory floor there is at least one bolster. In the present instance, there are two bolsters, an entry bolster 26 and an exit bolster 27 arranged end-to-end or in tandem, with an idle station 29 between bolsters as shown in FIG. 3. To operate the press, there are preferably a total of four bolsters, two entry bolsters and two exit bolsters, used for rapid die changing as will become clear from the description to follow.

Figure 1:
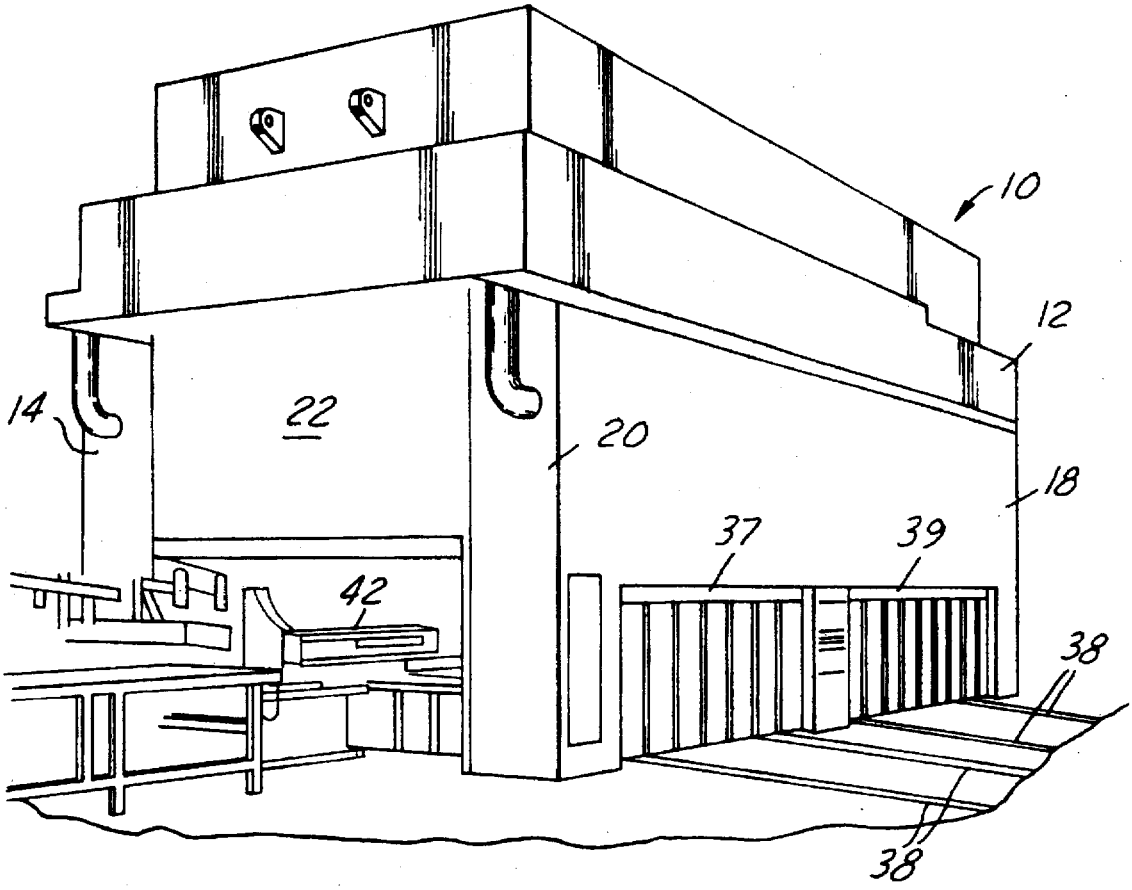
FIG. 1 is a perspective view showing a multi-stage transfer press constructed in accordance with the invention.

Each bolster 26, 27 supports a row of equally spaced-apart lower dies 28 of the die sets 30. In this instance, bolster 26 supports three lower dies 28 and bolster 27 supports two. Each die set also has an upper die 32 vertically aligned with the lower die and carried by a ram 34 mounted on the head for vertical reciprocation in ways 35. Power units 33 are provided to reciprocate the ram. Each bolster has wheels 36 mounted on floor tracks 38, permitting the bolster to be moved on the tracks from an operative position inside the press to an inoperative position outside the press where the die sets may be removed and replaced. The tracks 38 extend out of both sides of the press so that dies may be loaded and unloaded from either side. FIG. 1 shows the press as having separate bays 37 and 39 each of which may receive separate bolsters and die sets.

A transfer mechanism 40 is mounted in the press to transfer workpiece blanks B horizontally, step-by-step, across the tops of the lower dies from one die to the next between downward strokes of the ram. With each downward stroke, the blanks are progressively formed by the sequence of die sets into finished parts. Suitable blank feed mechanism 42 is provided for feeding blanks into the press.

Figure 6:
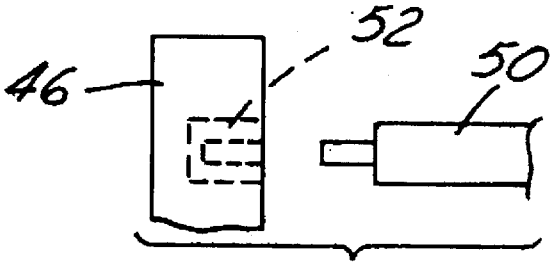
FIG. 6 is an enlarged fragmentary view in section showing the removable connection between a side rail and a cross bar of the transfer mechanism.

The transfer mechanism 40 comprises a pair of horizontal, laterally spaced-apart, longitudinally extending, parallel side rails 46 and 48 which extend along opposite sides of the row of lower dies, and a plurality of longitudinally spaced-apart cross bars 50 extending between the side rails perpendicular thereto. The side rails have connectors in the form of sockets 52 (FIG. 6) for releasably receiving the reduced ends of the cross bars. The spacing between the cross bars is the same as the distance from center to center of the die sets. The cross bars have suitable grippers, such as suction cups 56, for gripping the blanks and transferring them between dies. Suitable means, not shown, are provided for activating and de-activating the grippers. Guides 57 and actuators 58 are provided for longitudinally reciprocating the side rails, and raising and lowering them as needed to transfer workpiece blanks.

Mounted on each bolster 26, 27 are a plurality of cross bar stands 60. The cross bar stands 60 are arranged in pairs so that there are two cross bar stands for each cross bar. The stands of each pair are located in laterally spaced-apart relation in rows on opposite sides of the row of lower dies. The stands 60 serve no function during operation of the press as the ram 34 moves up and down and the transfer mechanism advances blanks between strokes of the ram, but serve to support the ends of the cross bars 50 after they have been detached from the side rails 46 and 48 following de-activation of the press when it is desired to move the bolster out of the press to an inoperative position for a die change, for example.

Figure 4:
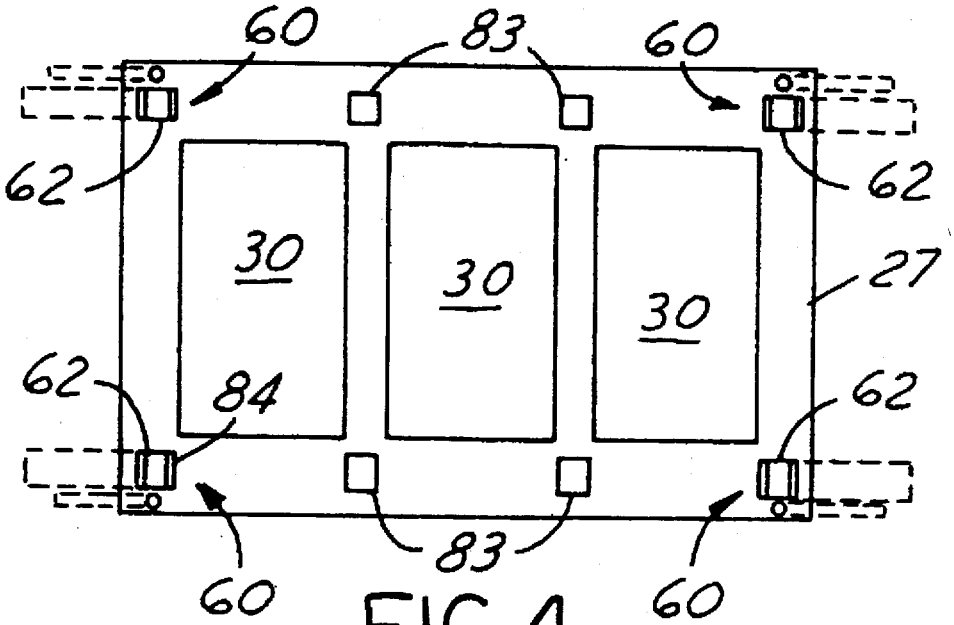
FIG. 4 is a top plan view of one of the bolsters of FIG. 3, shown outside the press with the cross bars removed, the corner stands upright in solid lines but tilted outwardly in broken lines, and the remaining stands removed.

Each stand 60 comprises an elongated strut 62 having a generally U-shaped channel 84 at the top for receiving an end of a cross bar 50 and releasably holding it in a predetermined position. In the present instance, the stands of each bolster at both ends of each row of stands are pivoted to enable them to be swung away from the dies. As an alternative, only the stands at one end might be pivoted while the stands at the other end could be rigid or removable. The remaining stands 60 of each bolster between the ends are removable, fitting in sockets 83 in the bolster. FIG. 4 shows the four corner stands of the exit bolster 27 upright in solid lines and tilted outwardly in broken lines, and the remaining bolsters removed.

The strut 62 of each corner cross bar stand 60 has a transverse arm 63 that has one end rigidly attached to the bottom of the strut. The other end of the arm is pivoted on a pin 64 carried by a block 66 secured to the top surface of the bolster for swinging movement from a vertical, upright position to a retracted, outwardly inclined position away from the dies. See FIG. 5. In the outwardly inclined position, the strut engages a stop 68 on block 66. In the upright position, a pin hole 70 near the lower end of the strut aligns with a pin hole 72 in a block 74 secured to the bolster so that a pin 76 inserted in the aligned holes 72 and 74 secures the strut in the upright position.

An elongated cylinder 78 parallel to each strut 62, is secured thereto by brackets 80. Cylinder 78 is provided to perform the function of raising and lowering the cross bars to the level of the side rails for connection and disconnection thereto to permit removal of the bolster to facilitate die changing.

In the operation of the press, the bolsters are inside the press (FIG. 3) and support the lower dies 28 directly beneath the upper dies 32. Between strokes of the ram, the transfer mechanism 40 is reciprocated longitudinally to move blanks from one lower die to the next. The cross bar stands are disposed vertically at a level below the transfer mechanism and are not involved in, and do not interfere with, the transfer of blanks.

When it is desired to change dies, the ends of the cross bars 50 are first released from the connector sockets 52 of the side rails 46 and 48. This can be accomplished by shifting the side rails slightly laterally outwardly by suitable means (not shown). The ends of each released cross bar are placed in the channels 84 on the tops of struts 62, the struts, of course, being in their upright position. The ram 34 is lowered to place the upper dies 32 on the respective lower dies 28, the upper dies are released from the ram and the ram is raised. At this time the cross bars are between die sets. The bolsters, supporting both the upper and lower dies of each die set 30, and with the cross bars 50 extending between adjacent die sets and supported on the stands 60, are moved on tracks 38 to an inoperative position to one side of the press.

Figure 5:
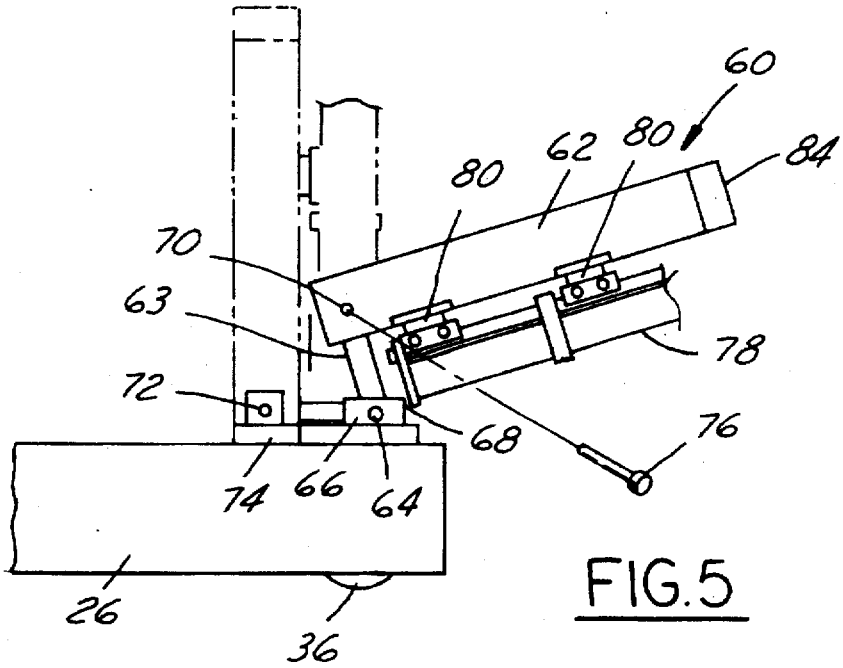
FIG. 5 is a fragmentary enlargement of a portion of the bolster showing one of the cross bar stands tilted outwardly in solid lines and upright in broken lines.

When the bolsters are outside the press, the cross bars 50 are removed from the stands 60, after which the corner stands are released from their upright positions by removing pins 76, and swung outwardly until engaged by the stops 68 (FIGS. 4 and 5). The remaining stands 60 are removed. An overhead crane has a cable 85 which may now be used to lift and remove the die sets from the bolsters. The same crane may be employed to place new die sets on the bolsters.

The reason for retracting and/or removing the stands 60 is to provide additional clearance during the removal of one set of dies from the bolster and replacement of other die sets. If the pivoted stands were left upright and the removable stands were not removed, there would not be enough clearance (see FIGS. 3–5) to preclude accidental contact between the die sets and stands as the die sets are being transferred by the crane. Such accidental contact can damage and/or distort the stands.

After the new die sets are in position on the bolsters, the pivoted stands are returned to their upright positions and the removable stands are replaced. The cross bars 50 are returned to the channels 84 of the struts. The bolsters are moved back inside the press where the cross bars are removed from the stands 60 and re-attached to the side rails 46 and 48.

If the stands 60 are damaged or twisted or bent as the die sets are removed from the bolster and replaced, the stands will not support the ends of the cross bars in correct position for re-attachment to the side rails. The result could be breaking of the side rail connectors 52, and distortion of the side rails and/or the cross bars. For that reason, the stands are retracted out of the way when the die sets are being removed and replaced.

Figure 2:
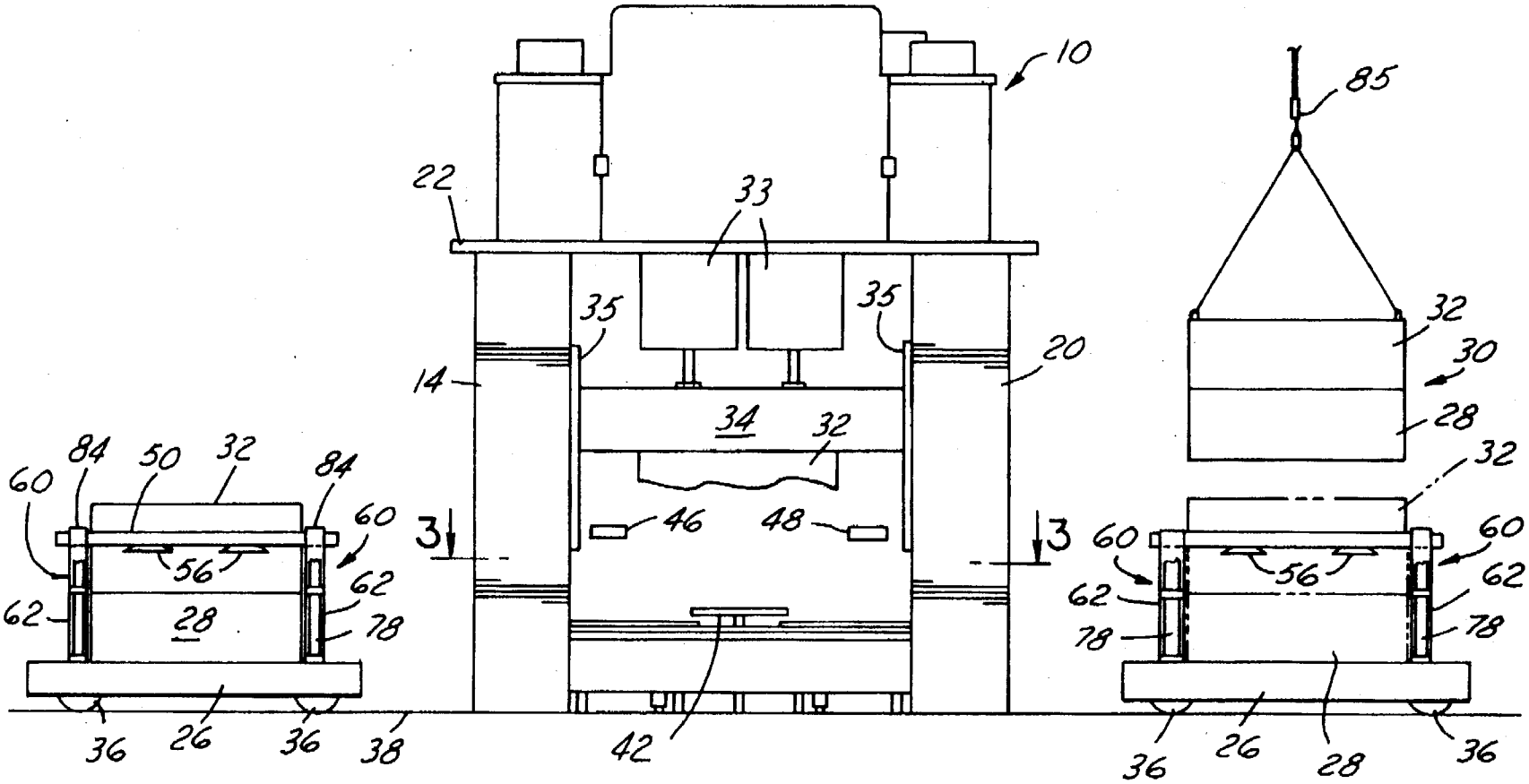
FIG. 2 is an end view of the press with bolsters at both sides of the press.

FIG. 2 shows two bolsters, one on either side of the press. This figure illustrates a condition in which one of the bolsters (the left bolster) has been removed from one side of the press and a second bolster with new dies is in position on the other side to be moved into the press for continued operation with a minimum of die changeover time. The bolster at the right in FIG. 2 was loaded with new dies by the crane 85 while the corner stands were tilted and the others removed, after which the corner stands were returned to upright position and the other stands were reinstalled, with the cross bars placed on the stands, for entry into the press. A total of four bolsters will usually be employed, so that two bolsters inside the press may be removed to one side of the press, and two new bolsters with new dies may be moved into the press from the opposite side.

What is claimed is:

1. In combination, a bolster for supporting a row of longitudinally spaced-apart die sets, each having an upper die and a lower die, for use in a transfer press, said bolster being movable from an operative position inside the press to an inoperative position outside the press where the die sets may be loaded on the bolster and unloaded therefrom, transfer mechanism for moving blanks along the row of die sets while the bolster is in its operative position, said transfer mechanism comprising a pair of elongated, laterally spaced-apart, parallel side rails extending along opposite sides of the row of die sets, first means mounting said side rails in the press for longitudinal reciprocation, cross bars having end portions releasably attached to said respective side rails in longitudinally spaced-apart relation along the length of said side rails, said cross bars having grippers for releasably gripping blanks to be stamped, a pair of cross bar stands on said bolster for each of said cross bars, the stands of each pair being disposed adjacent the respective end portions of each one of said cross bars, each of said stands comprising an elongated generally upright unit having an upper end and a lower end with a cross bar receiver at said upper end to removably receive and locate the end portion of a cross bar, said stands being adapted to removably support said cross bars temporarily after said cross bars have been detached from said side rails and the bolster is moved to its inoperative position and also to support said cross bars in positions for re-attachment to said side rails when the bolster is returned to its operative position, second means pivotally mounting the lower ends of some of said stands on said bolster for swinging movement thereof, after the cross bars have been removed therefrom, from said generally upright position to a retracted position far enough away from the dies to provide clearance when, in the inoperative position of the bolster, said die sets are being removed from the bolster and replaced by other die sets, and third means removably mounting those stands other than the pivotally mounted stands in said generally upright positions to permit removal thereof when, in the inoperative position of the bolster, said die sets are being removed from the bolster and replaced by other die sets.

2. The combination set forth in claim 1, and further including means on each of said stands for raising and lowering the associated cross bar to the level of the side rails for connection to and disconnection from said side rails.

* * * * *